US005617681A

United States Patent [19]

Lyons

[11] Patent Number: 5,617,681

[45] Date of Patent: Apr. 8, 1997

[54] FREE-STANDING OUTDOOR ENCLOSURE

[76] Inventor: Richard D. Lyons, HC 61 Box 174, Clewiston, Fla. 33440

[21] Appl. No.: 422,999

[22] Filed: Apr. 14, 1995

[51] Int. Cl.[6] ..... E04H 3/16; A45F 1/00

[52] U.S. Cl. ..... 52/82; 135/97; 135/124; 135/137; 135/157; 4/498

[58] Field of Search ..... 4/498, 494; 52/82; 135/87, 97, 124, 137, 157, 158, 159, 160, 120.3

[56] References Cited

U.S. PATENT DOCUMENTS

| | | | |
|---|---|---|---|
| 3,004,542 | 10/1961 | Moody | 135/97 |
| 3,424,178 | 1/1969 | Yazaki | 135/157 |
| 3,475,768 | 11/1969 | Burton | 4/498 X |
| 3,683,427 | 8/1972 | Burkholz et al. | 52/82 X |
| 3,749,107 | 7/1973 | Laberge | 135/137 |
| 3,855,643 | 12/1974 | Sanford et al. | 135/124 X |
| 3,924,367 | 12/1975 | Stewart | 52/82 X |
| 4,036,244 | 7/1977 | Huddle | 135/97 X |
| 4,118,904 | 10/1978 | Sprung | 135/97 |
| 4,136,408 | 1/1979 | Dahlbeck et al. | 4/498 X |
| 4,246,663 | 1/1981 | Aragona et al. | 4/498 X |

*Primary Examiner*—Wynn E. Wood
*Attorney, Agent, or Firm*—William E. Noonan

[57] ABSTRACT

A free-standing outdoor enclosure is disclosed. The enclosure includes a frame having a lower section that engages the ground, a side section mounted to and extending upwardly from the lower section and a roof section attached to the side section. The side section includes a plurality of elongate support segments that are arranged about the periphery of the enclosure. The roof section has a like plurality of elongate, flexible support elements interconnected in a radial arrangement. A distal end of each support element is attached to an upper end of respective support segment such that the flexible support elements are flexed into an upwardly arched condition. A flexible skin is mounted to the frame and extends across the side section and the roof section to hold the flexible support elements in the arched condition and define an enclosed space.

17 Claims, 8 Drawing Sheets

FREE-STANDING OUTDOOR ENCLOSURE

FIELD OF THE INVENTION

This invention relates to a free-standing outdoor enclosure and, more particularly, to a structure for enclosing above-ground swimming pools and the like.

BACKGROUND OF THE INVENTION

Screen enclosures are widely used to provide privacy and protection against insects. Such enclosures are commonly utilized in connection with porches, patios and both in-ground and above-ground swimming pools. Very often, screen enclosures are designed to be relatively permanent structures, which may be either free-standing or attached directly to a building. However, for certain uses, such as above-ground pools, a temporary or portable enclosure is desired.

A number of conventional screen enclosures are known for use in connection with above-ground pools. See, for example, Burkholz, et al., U.S. Pat. No. 3,683,472 and Dahlbeck et al., U.S. Pat. No. 4,136,408. These structures invariably exhibit a number of disadvantages. Most significantly, each requires direct attachment to and support by the walls of the pool itself. This necessitates the use of mounting brackets, which must be assembled and mounted to the walls of the pool. When the enclosure is removed, the unsightly and potentially dangerous brackets remain attached. Additionally, standard above-ground pool enclosures employ a framework that is not incorporated integrally within the flexible mesh fabric of the enclosure. Instead, separate brackets are utilized to attach the flexible covering to the frame. Known enclosures also tend to restrict use of the above-ground pool by adults and taller children. These enclosures usually include a generally dome-shaped roof that angles inwardly from the upper sides of the pool. As a result, head room is limited, particularly proximate the sides of the pool. Average-size adults are not able to stand upright unless they are near the center of the pool. This obviously limits the full use and enjoyment of the entire pool by adults and taller children. It also presents a dangerous problem in the event of a water emergency, when full maneuverability of rescuers is required.

A need therefore exists for an improved portable enclosure that may be used in conjunction with above-ground pools such that the above difficulties are eliminated. A need also exists for an improved, free-standing outdoor enclosure construction, which may be incorporated into a gazebo, greenhouse or other outdoor structure, and which may be conveniently transported for camping and similar uses.

SUMMARY OF INVENTION

It is therefore an object of this invention to provide a free-standing enclosure for above-ground swimming pools and other structures that does not have to be mounted to or supported by the pool walls or other parts of the structure being enclosed.

It is a further object of this invention to provide a free-standing enclosure which integrally combines a tubular framework and a flexible skin to achieve improved strength and rigidity.

It is a further object of this invention to provide an enclosure for an above-ground pool which provides improved head room within the enclosure and permits adults and taller children to maneuver freely and comfortably in all areas of the pool.

It is a further object of this invention to provide a free-standing outdoor enclosure that eliminates much of the assembly and hardware required by previous enclosures.

It is a further object of this invention to provide a free-standing outdoor enclosure that may be used in a variety of outdoor applications, such as swimming pools, gazebos, spas, greenhouses, camping and porches.

it is a further object of this invention to provide a portable, free-standing outdoor enclosure that is relatively easy and convenient to assemble, disassemble, transport and store.

This invention results from a realization that a portable, free-standing enclosure having improved strength and exhibiting improved head room may be achieved by constructing a frame comprising a radial plurality of flexed tubular support elements that are attached to respective vertical support elements. This construction is improved even more by integrally connecting the frame to a flexible skin composed of mesh or some other suitable substance. In such a structure, the skin serves to enhance the strength and support provided by the frame and helps to hold the flexed support elements under a required tension or stress. Employing vertical support elements to define the sides of the apparatus and, more specifically, arranging, these support elements radially outwardly of the above-ground pool or other structure being enclosed provides that structure with head room and maneuverability that are much improved over that provided by the enclosures of the prior art, which typically exhibit angled and not substantially vertical side supports.

This invention features a free-standing, outdoor enclosure. The enclosure includes a frame having, lower, side and roof sections. The lower section has means for engaging the ground. The side section is mounted to and extends upwardly from the lower section and includes a plurality of elongate, substantially vertical support segments that are arranged about the periphery of the enclosure. The roof section has a like plurality of elongate, flexible support elements interconnected in a radial arrangement. There are means for attaching a distal end of each support element to an upper end of a respective vertical support segment such that the flexible support elements are flexed into an upwardly arched condition. A flexible skin is mounted to the frame and extends across the side section and the roof section to hold the flexible roof support elements in the flexed condition and define the enclosed space.

In a preferred embodiment, the lower section includes a plurality of elongate, substantially vertical support members. The vertical support members may be arranged in a generally cylindrical pattern around a structure being enclosed. The means for engaging may include a tab that is carried on a respective support member and inserted between the ground and a pool or other structure to be enclosed. The tab may carry means for interlocking the lower section with the pool or other structure. The means for engaging may alternatively include a spike carried by a respective support member and engageable with the ground to hold the frame in place relative to the ground. In an above-ground pool enclosure embodiment, the side portion preferably includes a second plurality of elongate support segments. Each of these is attached at one end to an upper end of a respective support member of the lower section and extends outwardly herefrom at an angle substantially greater than zero degrees and substantially less than ninety degrees relative to the ground. Each support segment of the second plurality has a second end that is attached to a lower end of a respective vertical support segment. In such cases, the vertical support segments of the side portion and the support members of the lower section define respective cylindrical patterns about the structure being enclosed. The side portion's pattern preferably has a diameter that is greater than the lower section's pattern. At least one of the support members of the side section may carry a hook for selectively engaging an upper edge of an above-ground swimming pool or other structure to be enclosed.

The means for attaching may include an angled fitting having a first receptacle for receiving the distal end of the support element and a second receptacle for receiving the upper end of the respective vertical support segment. A retaining element may extend about the frame and the skin to assist in holding the roof support elements in the flexed condition. A second retaining element may be similarly wrapped about the side section, and particularly, between the vertical support sediments and the second plurality of support segments, to assist in holding the roof support elements in the flexed condition. A hub member may be provided for radially interconnecting the support elements.

The flexible skin may comprise a plurality of interconnected pieces. Each piece extends between an adjacent pair of support elements and associated vertical support segments. Preferably the skin is integrally connected to the frame. The skin may include a plurality of roof channels. Each such channel receives a respective roof support element. The skin may also include a plurality of side channels, each of which receives a respective vertical side segment. In the embodiment that includes a second plurality of side support segments, the skin may include a plurality of lower side channels, each of which receives a respective one of the second plurality of side support segments. Typically, respective roof channels, side channels and lower side channels are aligned. A door may be formed through the skin within an area defined by the side section of the frame.

DETAILED DESCRIPTION OF PREFERRED EMBODIMENTS

Other objects, features and advantages will occur from the following description of preferred embodiments and the accompanying drawings, in which.

Figure 2:
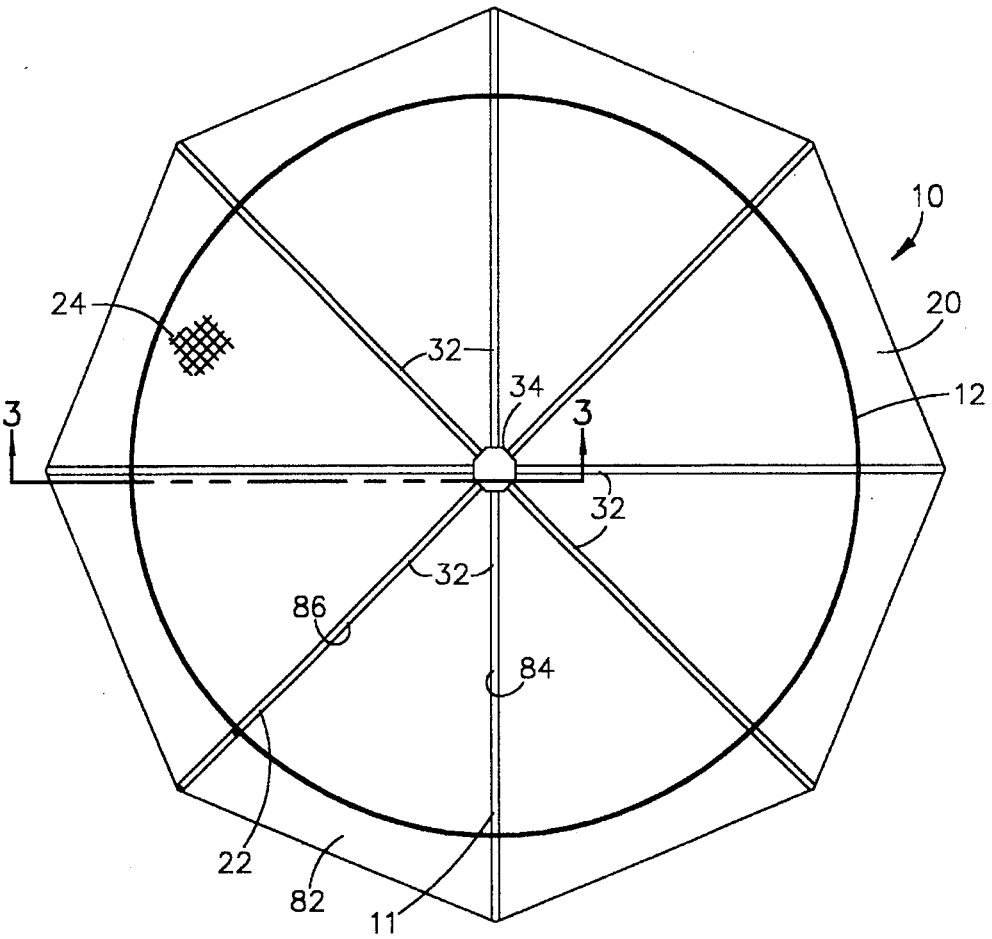
FIG. 2 is a plan view of the enclosure and pool of FIG. 1.

The free-standing outdoor enclosure of this invention is particularly useful in conjunction with an above-ground swimming pool. The structure may also be used for spas and patios, as a gazebo for overnight camping and in numerous other applications.

The enclosure is built by assembling a frame having lower, side and roof sections. Each of these sections preferably includes a plurality of elongate tubular support pieces comprising plastic or metal tubing or an analogous material such as fiberglass. In alternative embodiments, non-tubular support pieces may be employed. Typically, the lower section includes a plurality of vertically disposed support members arranged in a cylindrical pattern about the object to be enclosed. The side portion comprises a plurality of substantially vertical support segments that are arranged about the periphery of the enclosure and are respectively interconnected to upper ends of the support members in the lower section. The roof section includes a plurality of flexible support elements interconnected in a radial arrangement by a hub element. A PVC connector or similar means attaches the distal end of each flexible support member to the upper end of a respective vertical support segment such that the flexible support elements are flexed into an upwardly arched condition. This tensions the entire frame so that improved rigidity and support are achieved.

A flexible skin, which may comprise a plastic or metallic screen or mesh fabric, is mounted to the frame and extends across the side section and the roof section to hold the flexible support elements in the stressed condition. This skin serves as both a covering and as part of the support structure for the enclosure. The opening in the mesh can have various sizes. The skin may also comprise a solid plastic sheet or some alternative non-mesh construction. A sheet may be particularly useful if the enclosure is employed as a greenhouse, for example.

The skin is preferably integrally attached to the frame. This means that the support pieces (i.e. the support elements, segments and members) of the frame are largely wrapped or otherwise enclosed within the skin. The skin is itself secured directly to the frame without brackets, clips or other separate attachment means. For example, a plurality of channels are preferably formed in the skin for receiving respective tubular support pieces. The channels are formed, either in a unitary piece of skin material or, alternatively, at a junction where adjacent pieces of the skin are interconnected. As a result, the frame is mounted integrally with the skin. This provides an improved supportive enclosure wherein the skin acts, not only as an enclosure against insects and outdoor elements, but also as structural reinforcement for the frame. The skin holds the frame such that the lower and side sections are held proximate the periphery of the pool or other structure being enclosed, and the roof support elements are maintained in a stressed or flexed condition. Although not required, hooks and other attachment means may also be used to improve the temporary attachment of the side and lower support pieces to the object being enclosed.

In preferred embodiments, when the enclosure is employed with an above-ground pool, the side section of the frame bulges diametrically outwardly from the lower section. In such embodiments, the support members of the lower section are arranged peripherally about the pool. The roof section forms a dome over the above-ground pool. Because the side section bulges diametrically outwardly, adults and taller children have adequate headroom around the periphery of the pool and movement is not limited, as in conventional enclosed above-ground pools.

Various types of locking tabs and spikes may be carried by the support members of the lower section. These tabs are inserted between the pool and the ground and the spikes are introduced into the ground to position the support members.

One or more retaining elements may extend peripherally about the enclosure to help hold the support elements of the roof section in their stressed condition. These may comprise a cord or cable composed of nylon or some other material. Such retaining cords are typically sewn into the skin and surround the side section of the frame.

Figure 1:
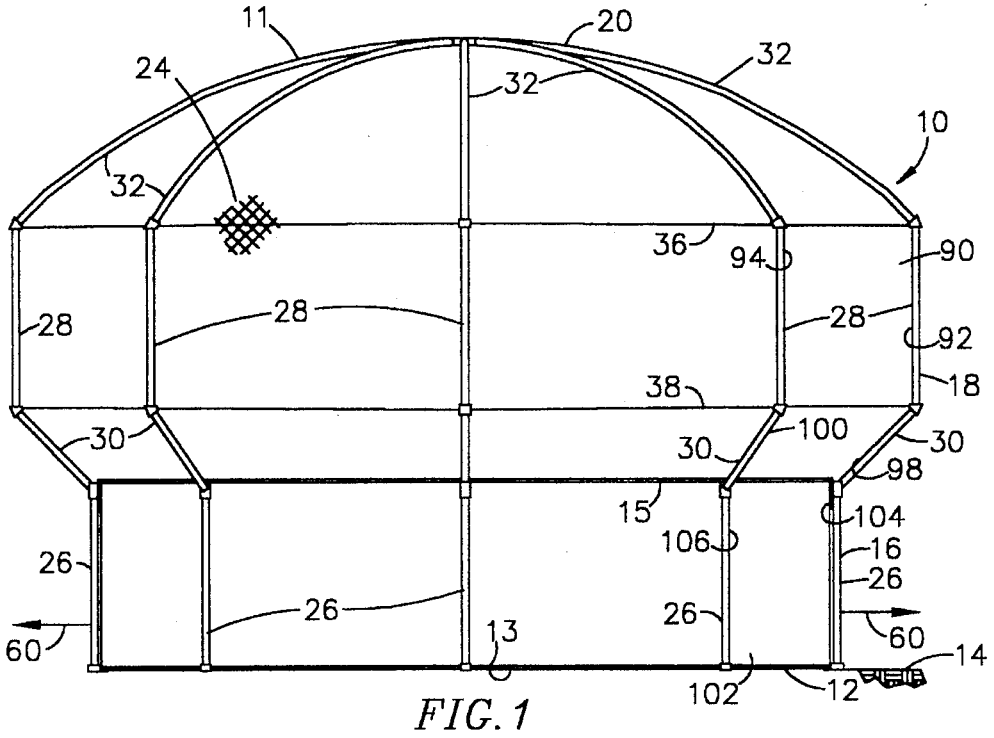
FIG. 1 is an elevational, side view of a preferred free-standing enclosure, which is erected to cover an above-ground swimming pool, in accordance with this invention.

There is shown in FIG. 1 an outdoor enclosure 10 constructed according to this invention. Enclosure 10 is erected to surround and enclose an above-ground swimming pool 12 that is disposed on ground 14 in a conventional manner. Pool 12 includes a floor 13 that engages ground 14 and an upper edge or rim 15. In the embodiment disclosed in FIGS. 1 and 2, pool 12 has a circular shape and enclosure 10 has an octagonal shape, although in alternative embodiments, the pool and enclosure may have various other shapes.

Enclosure 10 includes a frame 11 comprising a plurality of interconnected tubular pieces. Frame 11 generally features a lower section 16 that engages ground 14 and extends upwardly therefrom to a point just below upper edge 15 of pool 12. The frame also includes a side section 18, which extends outwardly at an angle from lower section 16 and then vertically upwardly. Finally, frame 11 includes a generally dome-shaped roof section 20 that is attached to the upper edge of side section 18. Roof section 20 covers the interior of enclosure 10 and pool 12.

A flexible covering or skin 24 is integrally connected to frame 11 in the manner described below. Each of the lower section 16, side section 18 and roof section 20 includes a respective plurality of tubular pieces that are interconnected to form the frame. As best shown in FIG. 1, lower section 16 includes a plurality of vertical support segments 26. Each element 26 extends from ground 14 to a point just below upper edge 15 of pool 12. Side section 18 includes a first plurality of vertically disposed support elements 28 and a second plurality of angled support segments 30. Each segment 30 extends generally outwardly and upwardly at an angle from the side of pool 12 and is interconnected between the upper end of a respective support member 26 and the lower end of a respective support segment 28. As is illustrated in FIG. 2, frame 11 also includes a plurality of flexible roof support elements 32 that are interconnected in a radial arrangement by a hub element 34. The distal end of each support element 32 is interconnected to the upper end of a respective vertical support segment 28. Each support element 32 extends between the upper end of respective segment 28 and hub element 34 such that the support element 32 is held in a flexed or arched condition. Preferably, eight support elements 32 are employed. Analogously, eight sets of support segments 28, support segment 30 and support members 26 are utilized in frame 11, in the manner shown in FIG. 2. Each such set of interconnected tubular pieces within frame 11 includes, from top to bottom, a respective roof support element 26, side support segments 30 and 28 and lower support element 32.

Skin 24 is integrally mounted to lower section 16, side section 18 and roof section 20 of frame 11, in the manner that will be described below. As a result, when eight sets of interconnected tubular pieces are used, skin 24 maintains the generally octagonal shape depicted in FIG. 2. In alternative embodiments, different numbers of sets of tubular pieces may be used such that the enclosure defines other peripheral shapes. Upper and lower retaining elements 36 and 38, FIG. 1, are wrapped about side section 18 and sewn into skin 24 to help hold frame 11 in place, with each of the roof support elements 32 in a stressed condition.

Figure 3:
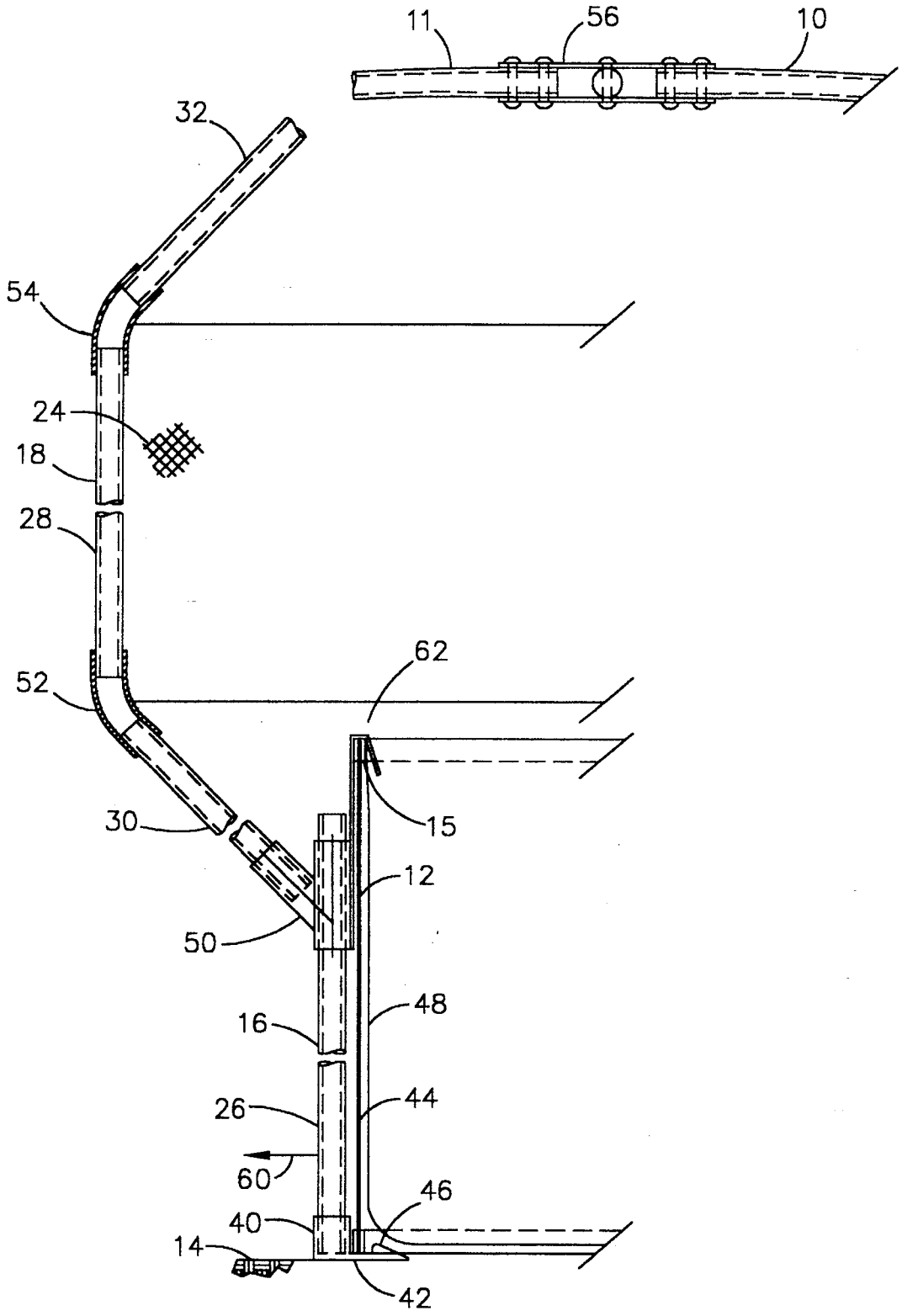
FIG. 3 is a cross sectional view taken along line 3—3 of FIG. 2.

The construction of frame 11 is more clearly depicted in FIG. 3. Therein, a single set of interconnected tubular pieces is illustrated. Each of the tubular pieces is broke for clarity. A similar construction is utilized for each other set of interconnected tubular pieces in frame 11.

Specifically, each of the tubular pieces 26, 30, 28 and 32 comprises a piece of plastic pipe. Varying diameters, thickness' and lengths of pipe may be utilized, depending upon the size and height desired for a particular enclosure 10. A fitting 40 engages ground 14 and includes a receptacle for receiving the lower end of a respective vertical support member 26. A generally flat retaining tab 42 is connected to the lower end of fitting 40. Retaining tab 42 slides beneath the side wall 44 of pool 12. A locking protrusion 46 prevents tab 42 from being pulled accidentally from the side wall 44. Fitting 40, tab 42 and protrusion 46 do not interfere with pool liner 48.

Figure 4:
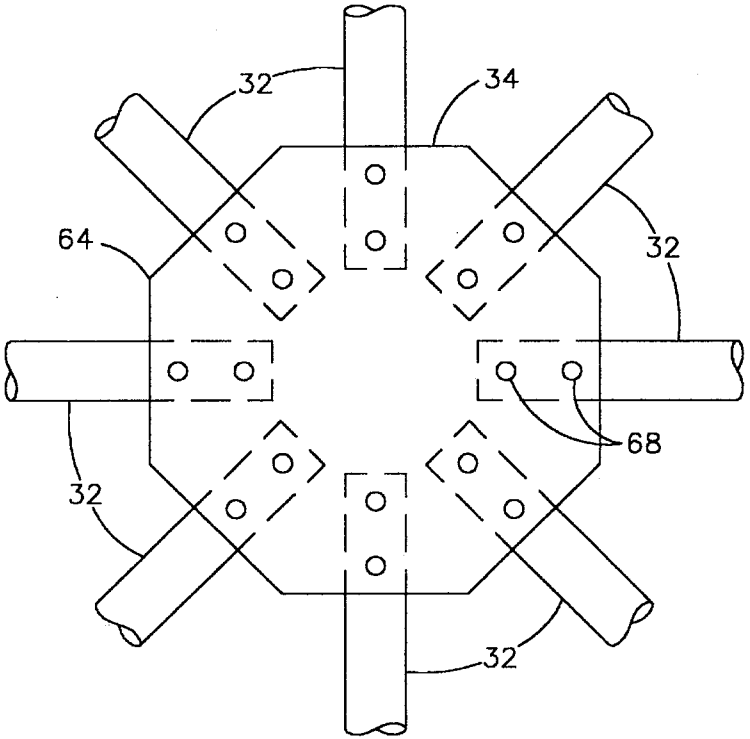
FIG. 4 is a plan view of a preferred hub element for radially interconnecting the elongate roof support elements of this invention.
Figure 5:
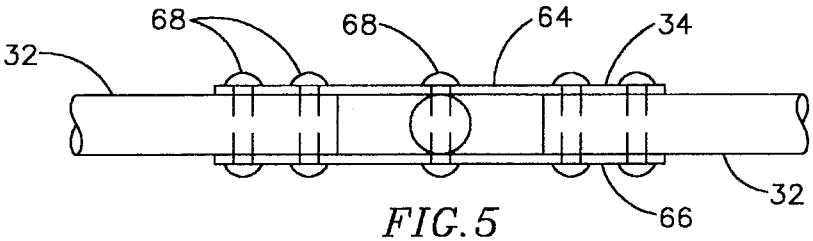
FIG. 5 is a side view of the hub element and attached roof support elements shown in FIG. 4.

The upper end of support member 26 is received beneath rim 15 of pool 12 by a receptacle in one end of an angled PVC connector 50. The other end of connector 50 includes a similar receptacle that receives a respective lower support segment 30 of side section 18. The opposite end of segment 30 is received by one receptacle of a second angled connector element 52. The opposite end of connector 52 includes a second receptacle that faces vertically and receives the lower end of a respective support segment 28. The opposite end of support segment 28 is fitted into a receptacle at one end of a third angled connector 54. The opposite end of connector 54 includes a second receptacle that receives a lower end of a respective roof support element 32. The opposite upper end of support element 32 is secured to hub element 34, the construction and operation of which will be described more fully below. The roof support element is held between connector 54 and hub element 34 such that the support element is flexed into an upwardly arched condition, as best shown in FIGS. 1 and 3. The flexing of the roof support elements 32 urges the lower support members 26 outwardly in the direction of arrows 60, FIG. 3. However, members 26 are held in position against the outside wall of pool 12 by the integral skin 24, the retaining elements 36 and 38 and the tabs and spikes described below. As shown in FIG. 3, a hook 62 may be secured to one of more of the lower support members 26. Hook 62 engages the upper edge 15 of pool 12. Such interengagement between enclosure 10 and pool 12 helps to prevent the enclosure from laterally shifting and better secures the enclosure in place around the pool. Notwithstanding this, enclosure 10 is totally free standing. The weight of the enclosure, and in particular the weight of roof section 20, side section 18 and lower section 16 are not supported in any way by the walls of the pool. Rather, the weight of the enclosure is transferred fully to support members 26 and, from there, to the respective fittings 40 that rest on ground A preferred hub element 34 is depicted in FIGS. 4 and 5. The hub element includes a pair of upper and lower parallel plates 64 and 66, respectively. Each of the plates has an octagonal shape. As a result, the hub element 34 defines eight sides, each of which corresponds to a respective flexible support element 32. The upper end of each support element 32 is received by a respective side of hub element 34 and fits between the upper and lower plates 64 and 66, in the manner shown in FIG. 5. A respective pair of standard screw or bolt connectors 68 secure the upper end of each member 32 to the spaced apart plates 64 and 66.

Figure 6:
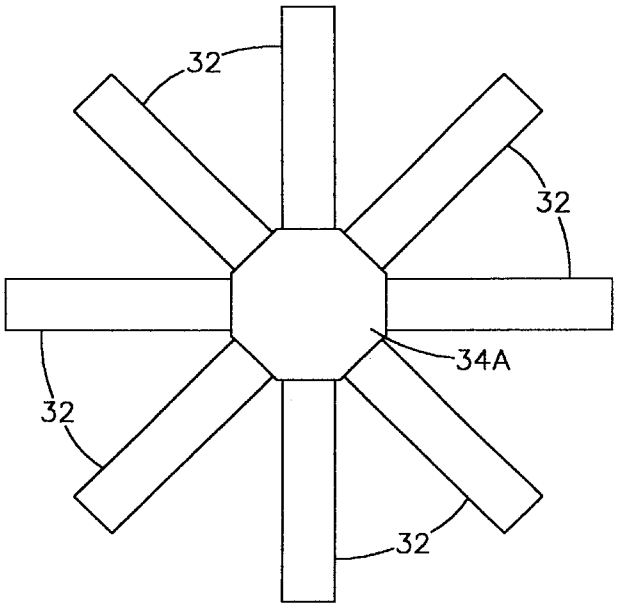
FIG. 6 is a plan view of an alternative hub element for radially interconnecting the roof support elements.
Figure 7:
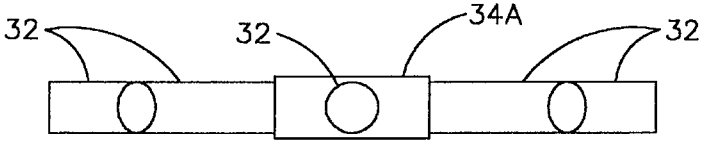
FIG. 7 is side view of the alternative hub element and attached roof support elements of FIG. 6.

An alternative hub element 34*a* is depicted in FIGS. 6 and 7. Hub element 34*a* comprises a unitary molded piece that is composed of PVC or other materials similar to the support element 32. Again, roof support elements 32 comprise flexible tubular elements. Each such element includes an upper end that is received by an opening in a respective side of hub element 34*a*. Therefore, as in the prior embodiment, support members 32*a* are arranged in a radial configuration. In alternative embodiments, various other numbers of support elements 32 may be utilized and the shape of the hub element may be varied accordingly so that each support element corresponds with a respective side of the hub element.

Figure 8:
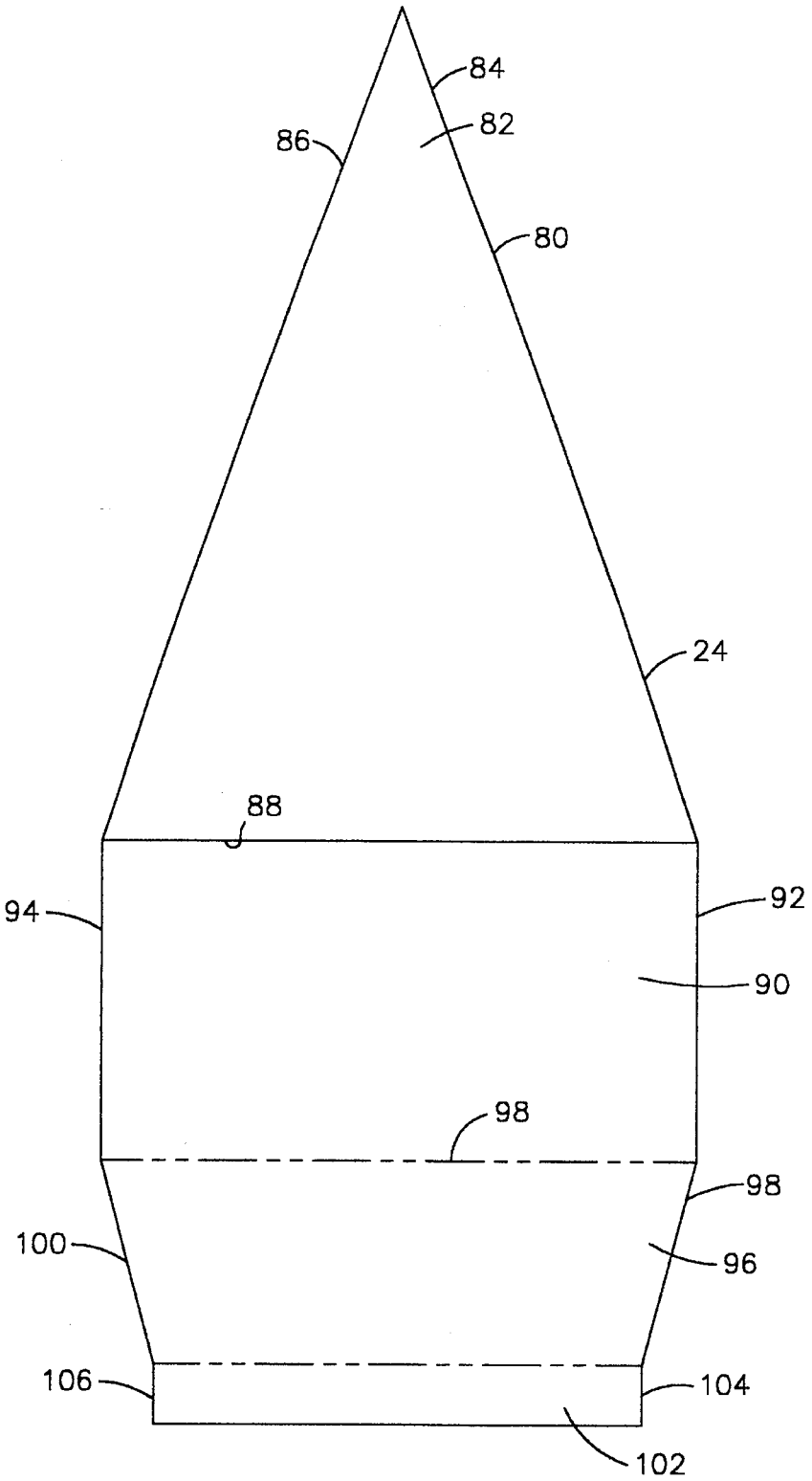
FIG. 8 is an elevational side view of one segment of a multiple piece flexible skin employed in the enclosure of FIG. 1.

Skin 24, FIGS. 1–3, may comprise a single piece of flexible material mounted to frame 11. Alternatively, the skin may be composed of a plurality of interconnected segments. A single such segment 80 is illustrated in FIG. 8. As previously described, skin 24 preferably comprises a mesh fabric, although various other types of non-fabric (e.g. molded) mesh and non-mesh material may be utilized. Typically, each segment 80 of skin 24 is interconnected between a pair of adjacent sets of tubular pieces, a single set of which is shown in FIG. 3. In the embodiment described herein, enclosure 10 includes eight segments 80. Each segment defines a respective side of the generally octagonal enclosure.

In particular, each segment 80 includes a generally triangular roof portion 82. The sides 84 and 86 of roof portion 82 extend generally along respective roof support elements 32 in the manner illustrated in FIG. 2. Roof portion 82 includes a lower edge 88 that separates the roof portion from a generally vertical skin portion 90. This portion of piece 80 includes sides 92 and 94 that extend along respective side support segments 28. A lower side portion 96 is separated from upper side portion 90 by a generally horizontal line 98. Typically, portions 90 and 96 are unitarily joined. Roof portion 80 may also be unitarily connected to upper side portion 90, although it is preferred that the roof portion 80 be stitched or sewn to side portions 90 alone line 88. Lower side portion 96 includes side edges 98 and 100 that extend along respective lower side support segments 30. Finally, a lower skin portion 102 depends from lower side portion 96. Side edges 104 and 106 extend along respective vertical support members 26, shown in FIG. 1.

Figure 9:
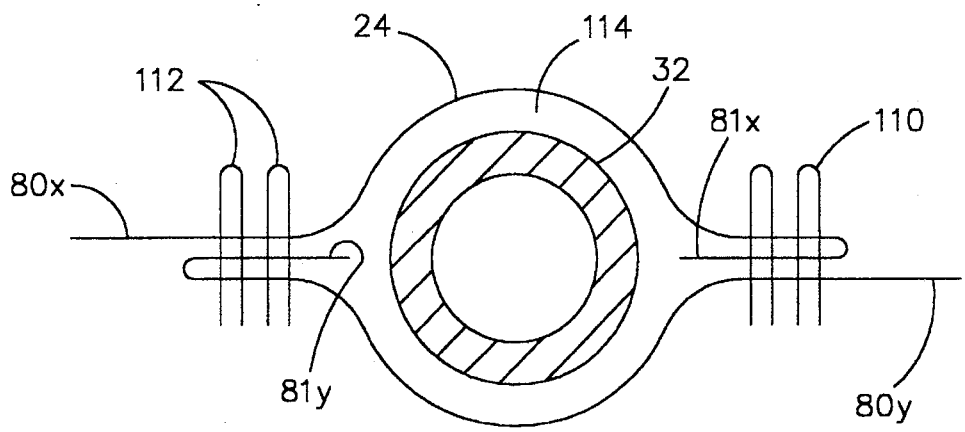
FIG. 9 is a cross sectional view of a preferred means for integrally connecting, a tubular support piece to respective adjoining pieces of the skin.

Eight of the above described pieces 80 are joined together to define skin 24. In particular, a preferred method of joining the individual pieces of the skin and integrally mounting the skin to the frame is shown in FIG. 9. Herein, the adjoining pieces are designated 80*x* and 80*y*. This technique is described in connection with a respective roof support element 32. However, it should be understood that adjoining pieces 80 of skin 24 are connected in a similar manner along the remaining tubular support pieces and connecting pieces in each set of such pieces in frame 11. One end of first piece 80*x* of skin 24 is wrapped over a portion of the outer surface of tubular support element 32. The distal end 81*x* of piece 80*x* is turned inwardly. Similarly, the second piece 80*y* of skin 24 is wrapped over the remaining exterior surface of member 32 and its end 81*y* is also turned inwardly. As a result, end 81*x* of piece 80*x* engages adjoining piece 80*y* and end 81*y* of piece 80*y* similarly engages piece 80*x*. The interengaged pieces 80*y* and 80*x* are then sewn together by appropriate stitching 110 and 112 formed along respective sides of element 32. A channel 114 is effectively formed between the adjoining pieces 80*y* and 80*x* of skin 24. Each such channel extends from the bottom edge of the skin to the hub element 34, FIGS. 3, 4, and 6, located at the top of the roof section 20. Each channel 114 receives a respective set of tubular pieces and associated connector elements, one of which sets is depicted in FIG. 3. More particularly, each channel 114 receives a respective tubular element 32, connector 54, tubular segment 28, connector 52, tubular segment 30, connector 50 and tubular element 26. Stitching 110 and 112 are formed along the respective side of each such set of tubular support pieces.

Figure 10:
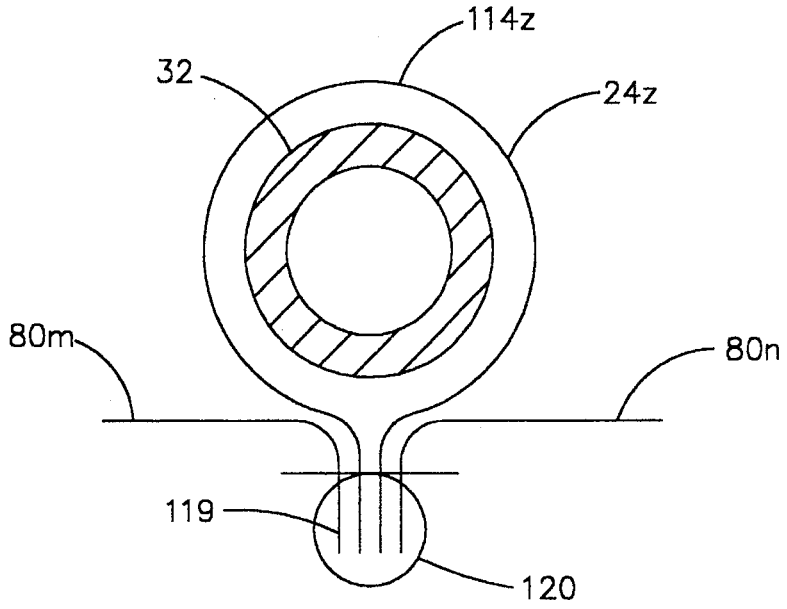
FIG. 10 is a cross sectional view of an alternative means for attaching a support piece element or segment to the exterior skin.

An alternative pocket 114 is depicted in FIG. 10. Therein segments 80*m* and 80*n* of skin 24 are turned inwardly. A separate elongate piece 24*z* of fabric or other skin-like material defining channel 114*z* is folded and a folded section 119 is interposed between the abutting ends of turned-in segments 80*m* and 8O*n*. The skin segments and the interposed section 119 of piece 24*z* are sewn or stitched together along a seam 120 to form channel 114*z*. The interconnected tubular support pieces of each set of such pieces represented by element 32 in FIG. 10, are received by a respective channel 114*z*. A channel having this construction is typically found between each pair of adjacent skin segments 80.

The skin may also comprise a single, unitary piece that is integrally connected to the support pieces in the frame. In such cases, a plurality of elongate pockets or channels are formed in the skin simply by wrapping the skin about each of the support elements, and similarly about each of the other tubular pieces in each interconnected set of such pieces. The channels of this version or the version of FIG. 10 may be formed on either the inside or outside of the enclosure. The channel of the one-piece skin is normally formed by interengaging one side of the skin with itself. The skin is then sewn or stitched together and the tubular support pieces are inserted into the channel. Again, this type of construction is employed for each set of interconnected support pieces illustrated specifically in FIG. 3.

Utilizing skin having either a unitary or a multi-piece construction, the enclosure 10 is provided with a frame and an outer skin that are integrally interconnected. As a result, skin 24 serves as a part of the supportive structure and helps to maintain tubular roof support segments 32 in their flexed condition so that the enclosure is properly tensioned to exhibit improved strength and rigidity. As shown in FIG. 1, reinforcing elements 36 and 38 are preferably sewn into the skin 24 about the entire perimeter of enclosure 10 to further improve the rigidity and strength of the enclosure.

Figure 11:
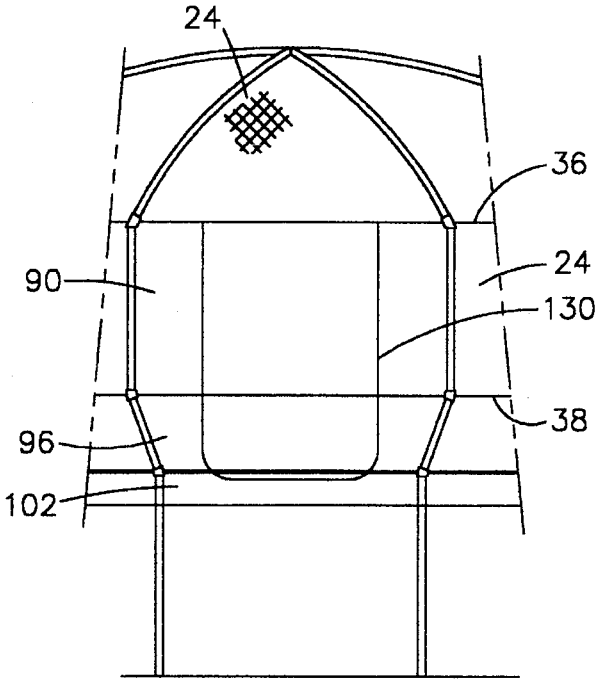
FIG. 11 is a side elevational view of a section of the skin, which includes a doorway into the enclosure.

As depicted in FIG. 11, a door flap or closure 130 may be formed in skin 24. Door 130 comprises a segment of skin 24 that is separated from the remainder of the skin along a line that defines a desired size and shape for the door. The flap extends downwardly from reinforcing element 36 and extends through side portions 90 and 96 of skin 24. A zipper or other conventional means may be used to secure door 130 to the remaining skin. The door flap is closed and opened, as required, to permit access into and out of the pool. The zipper is preferably constructed so that it may be operated from both inside and outside of the enclosure.

Figure 12:
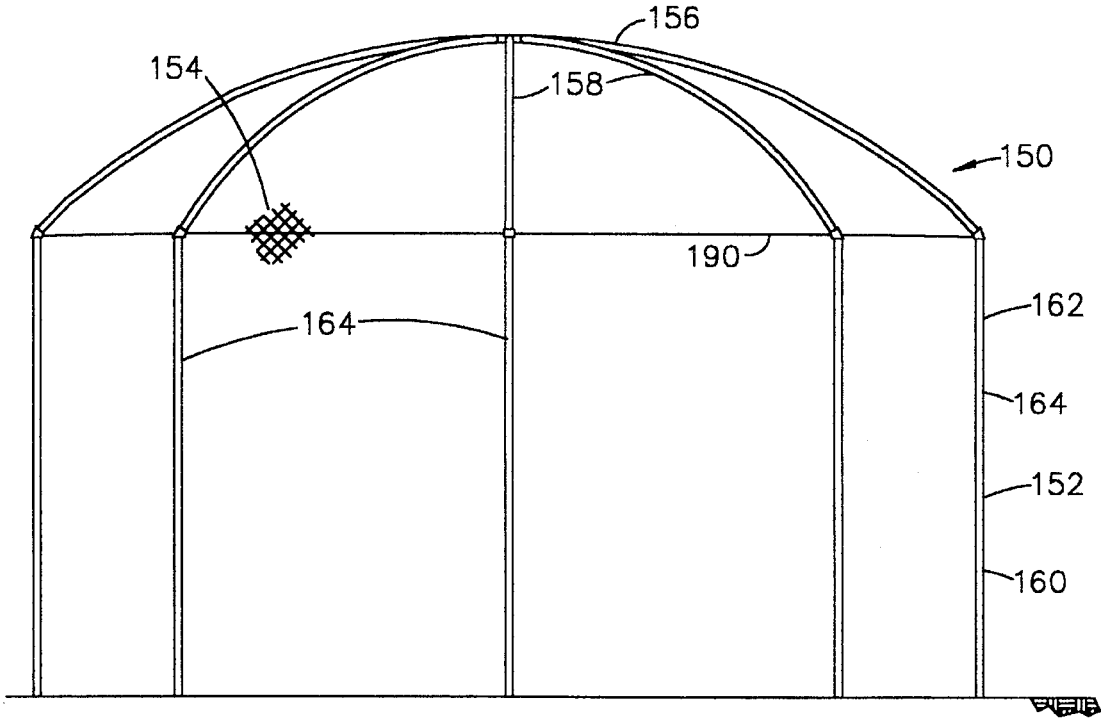
FIG. 12 is an elevational side view of an alternative free-standing enclosure in accordance with this invention; which embodiment is particularly effective for use with spas, gazebos and similar structures.

An alternative enclosure 150, manufactured in accordance with this invention, is depicted in FIG. 12. Enclosure 150 again includes a frame 152 comprising eight sets of interconnected tubular support pieces arranged in a generally cylindrical pattern. The enclosure also includes a mesh or solid skin 154 that is secured to frame 152 in the manner previously described.

Frame 152 includes a generally dome-shaped roof section 156 having a plurality of flexible support elements 158 that are stressed or arched upwardly in the manner previously described. The frame includes also includes a lower section 160 and a side section 162, which comprise eight substantially vertically arranged tubular support pieces 164. Unlike the previous embodiment, the side section 162 does not bulge diametrically outwardly from the lower section. Rather, the lower section 60 and side section 162 form a continuous cylindrical pattern, wherein the lower section 160 has substantially the same diameter as the upper end of side section 162.

Figure 13:
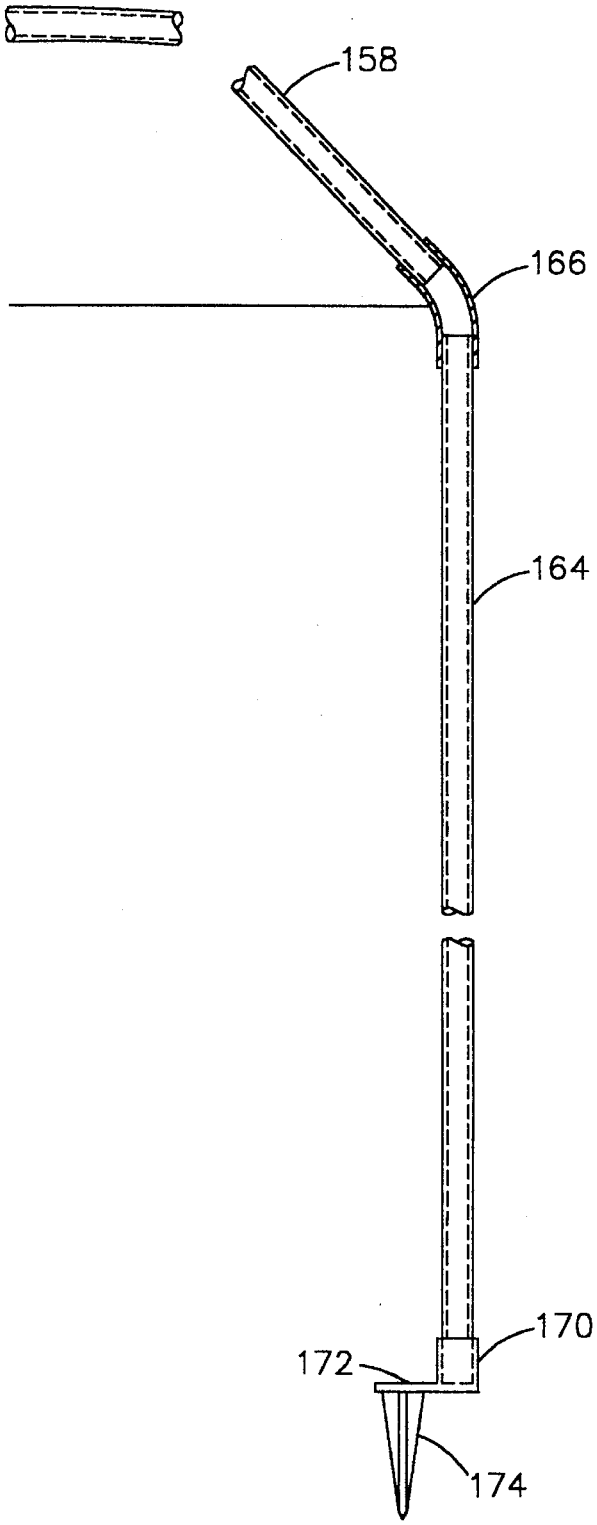
FIG. 13 is a partial, elevational view of the frame employed for the embodiment of FIG. 12, in particular illustrating one representative set of interconnected support pieces with the hub element omitted.

As in the previous described embodiment roof support elements 158 are held by a hub element in a generally radial arrangement. As shown in FIG. 13, each support element 158 is connected by a respective angled connector 166 to a respective vertical support piece 164. The lower end of each support piece 164 is received in a ground engaging fitting 170. Fitting 170 includes an inwardly extending fitting 172 that rests on the ground. A retaining spike 174 depends from fitting 172. Spike 174 is inserted into and grips the ground. Each vertical support piece 164 is provided with a fitting 170 and a spike 174 so that the entire frame is securely engaged with the ground. Grommets or other means may be provided along the lower edge of skin 154, FIG. 3, so that ropes, anchors and other attachment means may be employed to reinforce attachment of enclosure 150 to the ground.

Figure 14:
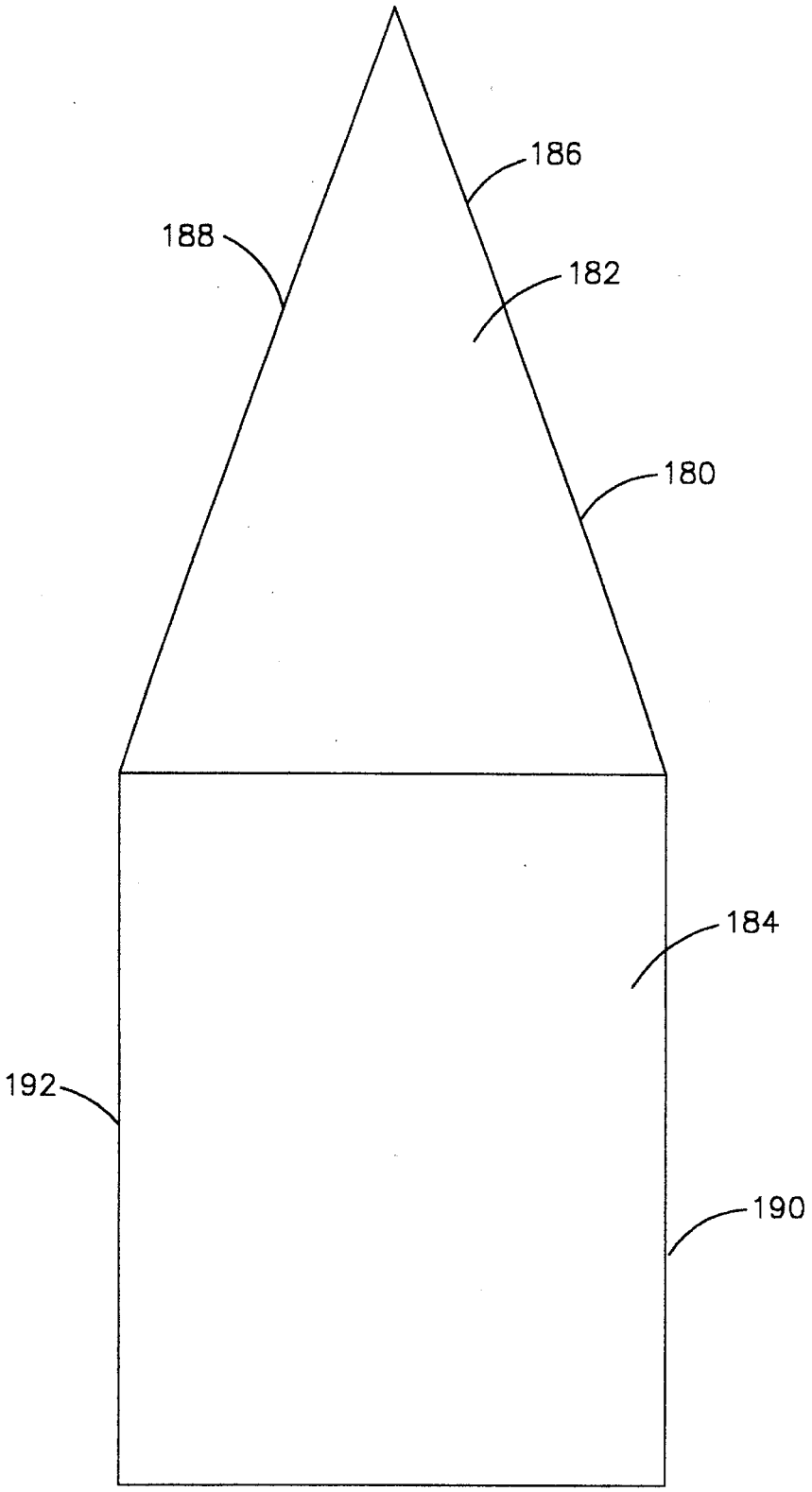
FIG. 14 is an elevational side view of a piece of the multiple piece skin used in the enclosure of FIG. 12.

Skin 154 may again comprise a single unitary piece or multiple interconnected pieces. A representative piece 180 of the multi-piece embodiment is illustrated in FIG. 14. Piece 180 includes a triangular roof portion 182 and a rectangular side portion 184. Roof portion 182 includes sides 186 and 188 that extend generally along respective roof support elements 158 (FIG. 12). Portion 184 likewise includes side edges 190 and 192 that extend along respective vertical supports 164. Preferably, portions 182 and 184 are unitarily interconnected. Eight pieces 180 are joined in a manner similar to the previously described embodiment, such that the tubular support elements 158 and 164 are received in respective pockets or channels formed between the adjoining pieces 180 of skin 154. Alternatively, a single piece skin having channels formed in the manner shown in FIG. 10 may be likewise utilized in this embodiment.

The embodiment of FIGS. 12–14 is particularly useful as a gazebo and for sheltering spas, patios and other such areas. It also provides a conveniently portable enclosure that maybe used for camping applications. The flexed roof support elements and the integrally interconnected skin again provide enclosure 150 with improved strength and rigidity. The vertical support pieces 164 and fittings 170 bear the weight of and provide free-standing support for the enclosure. Spiked fittings 170 also securely engage the ground so that unintended transverse movement of the enclosure is prevented. Again, various materials may compose the support pieces, although PVC and other forms of plastic tubing are preferred. The strength of enclosure 150 may again be improved by employment of a piece The embodiment of FIGS. 12–14 is particularly useful as a gazebo and for sheltering spas, patios and other such areas. It also provides a conveniently portable enclosure that maybe used for camping applications. The flexed roof support elements and the integrally interconnected skin again provide enclosure 150 with improved strength and rigidity. The vertical support pieces 164 and fittings 170 bear the weight of and provide free-standing support for the enclosure. Spiked fittings 170 also securely engage the ground so that unintended transverse movement of the enclosure is prevented. Again, various materials may compose the support pieces, although PVC and other forms of plastic tubing are preferred. The strength of enclosure 150 may again be improved by employment of a piece of reinforcing cordage 190 that is sewn or otherwise attached to skin 154 between roof portion 180 and side portion 184.

An appropriate door and doorway may also be provided in the side portion 184 of skin 154. Preferably, a walk-through doorway with an attached hinge door is utilized. Alternatively, the zippered flap of the previously disclosed embodiment may be constructed in one of the side panels of skin 154.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A free-standing enclosure comprising:

a frame that includes a lower section having a plurality of elongate, substantially vertical support members and means for engaging the ground, a side section mounted to and extending upwardly from said lower section and including a like plurality of elongate, substantially vertical support segments that are arranged about the periphery of the enclosure, a lower end of each said support segment being interconnected to an upper end of a respective said support member, a roof section having a like plurality of elongate, flexible support elements interconnected in a radial arrangement, and means for attaching a distal end of each flexible support element to an upper end of a respective support segment such that said flexible support elements are flexed into an upwardly arched condition and said support segments and said support members are urged radially outwardly, and flexible skin means, which extend across and are attached integrally to said lower, side and roof sections of said frame and which include a plurality of elongate channels, each said channel being wrapped fully around and receiving a respective interconnected support member, support segment and support element, for holding said flexible support elements in said flexed condition and resisting radially outward movement of said support segments and said support members to hold said frame in position and define an enclosed space.

2. A free-standing enclosure comprising:

a frame that includes a lower section having means for engaging the ground, said lower section including a plurality of elongate, vertical support members, a side section mounted to and extending upwardly from said lower section and including a plurality of elongate, substantially vertical support segments that are arranged about the periphery of the enclosure, a roof section having a like plurality of elongate, flexible support elements interconnected in a radial arrangement and means for attaching a distal end of each flexible support element to an upper end of a respective support segment such that said flexible support elements are flexed into an upwardly arched condition, said side portion further including a second plurality of support segments, each of which is attached at one end to an upper end of a respective support element and extending outwardly therefrom at an angle substantially greater than zero degrees but substantially less than ninety degrees relative to the ground, each support segment of said second plurality having a second end that is attached to a lower end of a respective vertical support segment, whereby said support segments of said side section and said support members of said lower section define respective patterns, each side section's pattern having a diameter that is greater than that of said lower section's pattern; and a flexible skin mounted to said frame and extending across said side section and said roof section to hold said flexible support elements in said flexed condition and define an enclosed space.

3. The enclosure of claim 1 in which said vertical support members are arranged in a generally cylindrical pattern about an area to be enclosed.

4. The enclosure of claim 1 in which said means for engaging include a tab that is carried by a respective support member and inserted between the ground and a pool or like structure.

5. The enclosure of claim 4 in which said tab carries means for interlocking said lower section with said pool or like structure.

6. The enclosure of claim 1 in which said means for engaging include a spike carried by a respective support member and being engageable with the ground to hold said frame in place relative to the ground.

7. The enclosure of claim 1 in which said side portion includes a second plurality of support segments, each of which is attached at one end to an upper end of a respective support element and extending outwardly therefrom at an angle substantially greater than zero degrees but substantially less than ninety degrees relative to the ground, each said support segment of said second plurality having a second end that is attached to a lower end, of a respective vertical support segment whereby said support segments of said side section and said support members of said lower section define respective patterns, said side section's pattern having a diameter that is greater than that of said lower section's pattern.

8. The enclosure of claim 1 in which said flexible skin includes a mesh substance.

9. The enclosure of claim 1 in which at least one of said support members carries a hook for selectively engaging an upper edge of an above-ground swimming pool.

10. The enclosure of claim 1 which said means for attaching include an angled fitting having a first receptacle for receiving the distal end of said support element and a second receptacle for receiving the upper end of said respective vertical support segment.

11. The enclosure of claim 1 further including a retaining element that is attached to said skin and extends about said frame to assist in holding said support element in said flexed condition.

12. The enclosure of claim 1 in which said flexible skin comprises a plurality of interconnected pieces, each piece extending between an adjacent pair or roof support elements and associated vertical support segments.

13. The apparatus of claim 2 in which said skin includes a plurality lower side channels, each of which receives a respective one of said support segments.

14. The enclosure of claim 7 in which said skin includes a plurality of lower side channels, each receiving a respective one of said support segments.

15. The enclosure of claim 1 further including a hub element for radially interconnecting said roof support elements.

16. The enclosure of claim 1 further including a door formed through said skin, at least partly within an area defined by said side section of said frame.

17. The enclosure of claim 11 in which a second retaining element is attached to said skin and wrapped about said side section of said frame to assist in holding said support elements in said flexed condition.

* * * * *